US007069247B1

(12) United States Patent
Oppedahl

(10) Patent No.: US 7,069,247 B1
(45) Date of Patent: Jun. 27, 2006

(54) AUTHENTICATION SYSTEM FOR MAIL PIECES

(75) Inventor: Carl Oppedahl, Summit County, CO (US)

(73) Assignee: Ascom Hasler Mailing Systems, Inc., Shelton, CT (US)

( * ) Notice: Subject to any disclaimer, the term of this patent is extended or adjusted under 35 U.S.C. 154(b) by 0 days.

(21) Appl. No.: 09/476,321

(22) Filed: Jan. 3, 2000

Related U.S. Application Data

(60) Provisional application No. 60/170,506, filed on Dec. 13, 1999.

(51) Int. Cl.
*G07B 17/00* (2006.01)

(52) U.S. Cl. ..... 705/62; 705/402; 705/408; 705/410; 705/60; 705/61

(58) Field of Classification Search ..... 705/62, 705/402, 408, 410, 60, 61
See application file for complete search history.

(56) References Cited

U.S. PATENT DOCUMENTS

| | | | | |
|---|---|---|---|---|
| 5,390,251 | A * | 2/1995 | Pastor et al. | 705/408 |
| 5,917,925 | A * | 6/1999 | Moore | 382/101 |
| 5,974,147 | A | 10/1999 | Cordery et al. | 380/25 |
| 6,009,416 | A * | 12/1999 | Pintsov | 705/410 |
| 6,041,704 | A * | 3/2000 | Pauschinger | 101/91 |
| 6,125,357 | A * | 9/2000 | Pintsov | 705/408 |
| 6,175,827 | B1 * | 1/2001 | Cordery et al. | 705/410 |
| 6,308,165 | B1 * | 10/2001 | Gilham | 705/62 |
| 6,385,504 | B1 * | 5/2002 | Pintsov et al. | 700/226 |
| 6,408,287 | B1 * | 6/2002 | Sansone et al. | 705/410 |

FOREIGN PATENT DOCUMENTS

EP 0845759 A2 6/1998

OTHER PUBLICATIONS

USPS environment, Facilities and workflow (Customer Value Analysis Supplemental Add-on Survey, Nov. 2000).*
New Mailing Equipment Can Bring Big Savings (Maguire, Michael D.; Office Systems v8n9 pp. 58-62, Sep. 1991).*

* cited by examiner

*Primary Examiner*—James P. Trammell
*Assistant Examiner*—Cristina Owen Sherr
(74) *Attorney, Agent, or Firm*—Perman & Green, LLP.

(57) ABSTRACT

An improved system is provided for authentication of mail pieces bearing bar-coded indicia. The system comprises first and second bar-code readers, the first and second bar-code readers differing in that the first bar-code reader has a lower rate of successful reading of bar-coded indicia than the second bar-code reader. The system collates a mail piece bearing an indicium in a second paper path in the event of a successful reading of the bar-coded indicium by said first bar-code reader, and collates mail pieces in a third paper path in the event of an unsuccessful reading of the bar-coded indicium by the first bar-code reader. The third paper path leads to the second bar-code reader, and the system collates mail pieces in a fourth paper path in the event of a successful reading of the bar-coded indicium by the second bar-code reader. The system collates mail pieces in a fifth paper path in the event of an unsuccessful reading of the bar-coded indicium by the second bar-code reader.

23 Claims, 1 Drawing Sheet

AUTHENTICATION SYSTEM FOR MAIL PIECES

Figure 1:
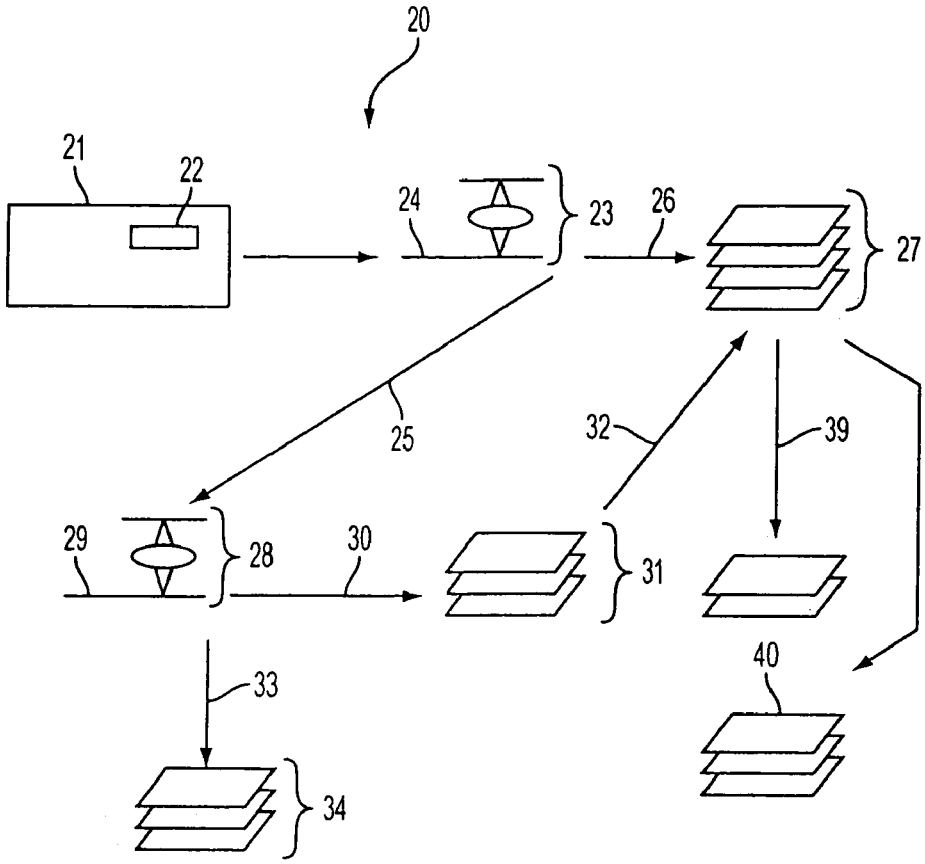

This application claims priority from U.S. Provisional Application Ser. No. 60/170,506, filed Dec. 13, 1999.

BACKGROUND OF THE INVENTION

For decades, postage meters have imprinted their postal indicia on envelopes by means of relief printing using printing dies. The indicia are generally formed with fluorescent ink of a distinctive color. Postage meters to serve such purposes are well known and reliable.

It has been proposed in recent years by some postal authorities to discontinue the use of die-printing postal indicia and instead to use off-the-shelf ordinary computer printers such as inkjet printers and laser printers for the printing of postal indicia. The use of off-the-shelf printers presents, of course, the profound problem of counterfeit indicia printed by parties wishing to print postage without having to pay for it. In an effort to reduce this problem, postal authorities have proposed to include within the postal indicia cryptographic information which is intended to permit the postal authorities to distinguish between counterfeit indicia on the one hand and legitimate indicia on the other hand. It is often proposed that the cryptographic information be printed on mail pieces by means of two-dimensional bar codes. Each such bar code contains information, such as CRC checksum, which serves to indicate whether the bar code has been correctly read.

The cryptographic authentication provides meaningful protection against counterfeit indicia only if the postal service treats authentic indicia differently than it treats counterfeit indicia. If mail pieces bearing counterfeit indicia are delivered by the postal service just as legitimate mail pieces are delivered, then this would become widely known and fraud would increase to high levels (given that the required printers are readily available).

A related problem is that cryptographic postal indicia, if printed in the form of two-dimensional bar codes, are not always easy to read. They will get smudged and smeared. They will be printed at skew angles relative to the edges of the mail pieces. They will have less than optimal contrast ratios. This presents the problem of what the postal service should do if it is unable to read a particular indicium on a mail piece.

It is instructive to discuss what counts as a "readable" bar code. Bar codes used in this context will contain a cyclical redundancy check, a checksum, a hash total, or some other test of the internal consistency of the bar code. As is well known to those skilled in the art, when the bar code is being generated, the "body" or text or content of the bar code is passed through a predetermined function. The function is preferably a cyclical redundancy check (CRC) polynomial but could less preferably be a checksum or hash function. The output of the function (for example, a CRC checksum) is noted and is written in the bar code along with the content. A bar code reader will read the body and the CRC checksum, and will pass the body through the same function yielding an output. This output is compared with the CRC checksum that was read from the bar code. If the bar code tests out to be internally inconsistent (for example by failing the CRC check) then we define this to mean that the bar code is "unreadable". If, on the other hand, the output matches the CRC checksum that was read from the bar code, then we define this to mean that the bar code is "readable".

In the case of an unreadable bar code, should the postal service deliver the mail piece anyway? Such an approach would encourage fraud. Persons with fraudulent intent would quickly learn to create bar codes which intentionally failed the CRC check so that they would be delivered without the nuisance of passing a cryptographic authentication.

In the case of an unreadable bar code, should the postal service return the mail piece to the sender? Given that many events, such as smudging or smearing, can male a bar code unreadable, such an approach would motivate mailers to use other franking means such as postage stamps or (if they are not outlawed) relief-type postage meters using printing dies. This awkward decision would repeat itself over a billion times a day in the United States where the daily mail volume is well in excess of a billion mail pieces daily, with a non-negligible percentage of mail pieces halving been rendered unreadable clue to smudging or smearing.

It is all too easy simply to say that the postal service would use bar-code readers with extremely high resolution and sophisticated software to deal with skew, poor contrast, and smudged and smeared indicia. Such bar code readers are very expensive. But even if modest-quality bar code readers were used, estimates of the cost to provide bar-code readers and authentication equipment for the United States are in the billions of dollars. Equipping every US Postal Service mail processing facility with high-quality readers instead of moderate-quality readers would put the nationwide installation cost at tens or hundreds of billions of dollars.

It would be extremely desirable to have an approach for the authentication of mail pieces bearing bar-coded indicia which would be reliable, inexpensive, and robust.

SUMMARY OF THE INVENTION

An improved system is provided for authentication of mail pieces bearing bar-coded indicia. The system comprises first and second bar-code readers, the first and second bar-code readers differing in that the first bar-code reader has a lower rate of successful reading of bar-coded indicia than the second bar-code reader. The system collates a mail piece bearing an indicium in a second paper path in the event of a successful reading of the bar-coded indicium by said first bar-code reader, and collates mail pieces in a third paper path in the event of an unsuccessful reading of the bar-coded indicium by the first bar-code reader. The third paper path leads to the second bar-code reader, and the system collates mail pieces in a fourth paper path in the event of a successful reading of the bar-coded indicium by the second bar-code reader. The system collates mail pieces in a fifth paper path in the event of an unsuccessful reading of the bar-coded indicium by the second bar-code reader.

FIGURES

Figure 2:
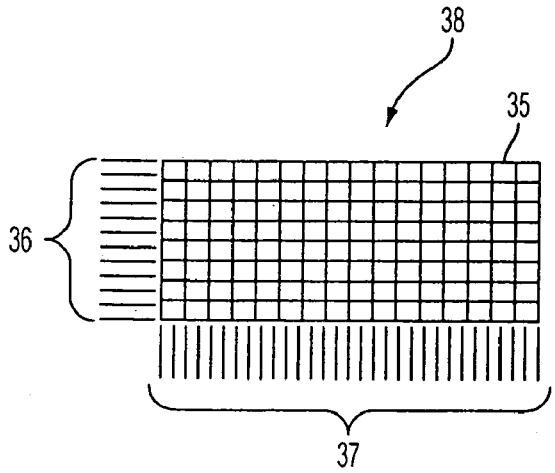

The invention will be described with respect to a drawing in several figures, of which:

FIG. 1 shows a workflow diagram according to all embodiment of the invention; and FIG. 2 shows a bar code indicium along with lines illustrating a scanning resolution for the indicium.

DETAILED DESCRIPTION

In a prior-art system, a mail piece has all indicium. The indicium may be authentic and readable, it may be counterfeit, or it may be authentic but unreadable (at least upon the first attempt to be read). The system must distinguish between these three possibilities. In the prior-art system the mail piece would pass by a bar code reader and the content of the bar code would be read. If the contents of the bar code were unreadable the mail piece would be returned to the sender. If the contents of the bar code were readable and passed the authentication test, then the mail piece would be delivered. Otherwise the postal service would conclude that the mail piece has a fraudulent indicium and would proceed with a criminal investigation leading to arrest and conviction of the sender.

FIG. 1 shows a workflow diagram of the system 20 according to an embodiment of the invention. A mail piece 21 bears an indicium 22. The mail piece is seen in edge view 24 and reaches a first bar code reader 23. Some percentage of mail pieces 24 will turn out to have bar codes which the reader 23 is capable of reading, and will proceed along path 26. Presumably a majority of the readable mail pieces will pass the authentication test proceeding to output 40, and will be delivered by the postal service. Some of the mail pieces with readable indicia, however, will fail the authentication test proceeding to output 39 and will presumably give rise to a criminal investigation.

Importantly, in the system 20 according to the invention the mail pieces which were incapable of being read proceed in an automatic way along path 25 to a second reader 28.

The first and second bar code readers are selected as will now be described. The second bar code reader 28 has a higher success rate at reading indicia as compared with the first bar code reader.

In a typical embodiment the second bar code reader has a higher resolution than the first bar code reader, that is, it scans the indicium by breaking it up into a larger number of rows and columns. Stated differently, it scans the indicium in a way that yields a much larger number of pixels when compared with the first reader, and each pixel is smaller. Such a reader is more expensive because its imaging array is more expensive, and because it must process more data to determine the bar code information content.

In a related embodiment the second bar code reader differs from the first reader by having deskewing functionality that is lacking in the first bar code reader, functionality that overcomes problems of the indicium being skewed relative to the mail piece edges.

In another related embodiment the second bar code reader is physically and optically identical to the first bar code reader but takes more time to make its reading. For example, the first bar code reader may have a linear array which detects light and dark areas as the mail piece passes perpendicular to the array. The first and second bar code readers may differ simply in the speed of the mail piece; the first reader may pass its mail pieces at a high speed and with limited control over angular skew of the mail piece, while the second reader may move its mail pieces more slowly and with a strict control eliminating any angular skew of the mail piece relative to the paper path.

In another embodiment the first reader uses a linear array which scans the indicium as the mail piece passes by the array. The second reader uses a two-dimensional imaging array to take a snapshot of the indicium. The mail piece may be motionless during the snapshot, or the second reader may use a strobe light to illuminate the indicium instantaneously even though it is in motion. In either case it will be appreciated that the second reader may have a higher success rate relative to the first reader, a success rate that stems from the more expensive imaging array or from the slower throughput of the system (because mail pieces are brought to a halt to have their picture taken) or both.

In the most generalized case, the second bar code reader is simply much more expensive or slower or both, when compared with the first bar code reader.

Returning to FIG. 1, the paper path 25 is seen by which a mail piece 29 having an indicium that cannot be read by the first reader 23 is passed to a second reader 28. If this reader is able to read the indicium then the mail piece proceeds along path 30 to optional stack 31. The mail piece may then be collated into the "authenticated" path to 40 or into the "counterfeit" path to 39, just as mail pieces successfully read by reader 23 are collated.

If, on the other hand, the reader 28 is unable to read a bar code, then the mail piece proceeds along path 33 to optional stack 34.

The process may be generalized. For example the twice-unreadable mail pieces 34 can be passed to a third reader omitted for clarity in FIG. 1. This reader may be even slower or even more expensive than the second reader 28.

It should be appreciated that if there were simply a single first reader 23 operatively connected with a single second reader 28, the everyday result would be that the first reader 23 is busy all of the time and the second reader would be busy only part of the time. The reason for this is that (by assumption) most of the bar codes would be readable by the first reader 23.

In the case where reader 28 is slower than reader 23, then this imbalance is partly returned to balance because although reader 28 gets fewer mail pieces than reader 23, it takes longer to process the mail pieces that it does receive.

In the case where reader 28 is not necessarily slower than reader 23 but is more expensive, then the imbalance presents the question why reader 23 is used in the first place. Thus, in an exemplary embodiment of the invention, there would be two or more readers in the position of reader 23, and a third reader in the position of reader 28. Document paths are defined so that if either of the readers 23 fails to read a bar code correctly, the offending mail piece would be passed on to third reader 28. Reader 28 is selected to have a higher success rate at reading difficult bar codes thin the readers 23, but as mentioned above it may be slower or more expensive than readers 23. It is thus desirable to cascade two or more readers 23 into reader 28. Stated differently, if any of the several readers 23 finds itself unable to read a bar code, then the mail piece is sent to reader 28.

The sending of the unreadable mail piece from first reader 23 to more-successful reader 28 is preferably performed without manual intervention. But it will be appreciated that the benefits of the invention present themselves even if such unreadable mail pieces are hand-carried from the "unreadable" path of reader 23 to an input of reader 28.

FIG. 2 shows a bar code indicium 35 along with lines 36, 37 illustrating a scanning resolution for the indicium. One way that reader 28 may have a higher success rate at reading bar codes is that it may have a finer resolution in the Y axis (lines 36) or the X axis (line 37). The resolution may be twice as fine as that of the reader 23. Appropriate software will then be employed to attempt to resolve potentially ambiguous pixels in the bar code so as to arrive at a reading of bar code content that manages to satisfy the CRC checksum.

In the case where the bar code reader 28 employs a linear sensing array, the array may be identical to that used in bar code reader 23 but with the mail piece stepped through much smaller steps, such as steps half as large as the steps used with reader 23.

In the case where the bar code reader 28 employs a scanning light source such as a laser, the higher success rate of reader 28 may result from a design decision to halt the mail piece long enough to scan the bar code.

What is claimed is:

1. An improved system for authentication of mail pieces bearing bar-coded indicia, the system comprising first and second bar-code readers, said first and second bar-code readers differing in that said first bar-code reader has a lower rate of successful reading of bar-coded indicia than said second bar-code reader, said system defining a first paper path through said first bar-code reader and subsequently through a first collator, said system disposed to collate a mail piece bearing an indicium in a second paper path in the event of a successful reading of said bar-coded indicium by said first bar-code reader, said system disposed to collate mail pieces in a third paper path in the event of an unsuccessful reading of said bar-coded indicium by said first bar-code reader, said third paper path leading to said second bar-code reader, said system disposed to collate mail pieces in a fourth paper path in the event of a successful reading of said bar-coded indicium by said second bar-code reader, said system disposed to collate mail pieces in a fifth paper path in the event of an unsuccessful reading of said bar-coded indicium by said second bar-code reader.

2. The improved system of claim 1 further comprising a third bar-code reader, said second and third bar-code readers differing in that said second bar-code reader has a lower rate of successful reading of bar-coded indicia than said third bar-code reader, said system further defining said fifth paper path through a second collator, said system disposed to collate mail pieces in a sixth paper path in the event of a successful reading of said bar-coded indicium by said second bar-code reader, said system disposed to collate mail pieces in a seventh paper path in the event of an unsuccessful reading of said bar-coded indicium by said second bar-code reader.

3. The improved system of claim 1 wherein the first bar-code reader is less expensive than the second bar-code reader.

4. The improved system of claim 1 wherein the first bar-code reader is faster than the second bar-code reader.

5. The improved system of claim 1 wherein the first bar-code reader has lower scanning resolution than the second bar-code reader.

6. A method for authenticating mail pieces bearing bar-coded indicia, the method comprising the steps of passing a mail piece bearing an indicium through a first bar-code reader, subsequently automatically collating said mail piece to a second paper path to a second bar-code reader in the event of an unsuccessful reading of said indicium by said first bar-code reader, said first and second bar-code readers differing in that said first bar-code reader has a lower rate of successful reading of bar-coded indicia than said second bar-code reader.

7. The method of claim 6 further comprising subsequently automatically collating said mail piece to a third paper path in the event of successful reading of said indicium by said second bar-code reader.

8. The method of claim 6 further comprising subsequently automatically collating said mail piece to a fourth paper path to a third bar-code reader in the event of an unsuccessful reading of said bar-coded indicium by said second bar-code reader, said second and third bar-code readers differing in that said second bar-code reader has a lower rate of successful reading of bar-coded indicia than said third bar-code reader.

9. The method of claim 8 further comprising subsequently automatically collating said mail piece to a fifth paper path in the event of successful reading of said indicium by said third bar-code reader.

10. The method of claim 8 further comprising subsequently automatically collating said mail piece to a sixth paper path in the event of unsuccessful reading of said indicium by said third bar-code reader.

11. The method of claim 7 further comprising the step of delivering the mail piece after said successful reading of said indicium by said second bar-code reader.

12. The method of claim 9 further comprising the step of delivering the mail piece after said successful reading of said indicium by said third bar-code reader.

13. The method of claim 6 further comprising subsequently automatically collating said mail piece to a fifth paper path in the event of an unsuccessful reading of said bar-coded indicium by said second bar-code reader.

14. The method of claim 13 further comprising the step of returning the mail piece to the sender after unsuccessful reading of said bar code by said second bar-code reader.

15. The method of claim 10 further comprising the step of returning the mail piece to the sender after unsuccessful reading of said bar code by said third bar-code reader.

16. The method of claim 6 further comprising subsequently performing a cryptographic authentication of said indicium and automatically collating said mail piece to a seventh paper path in the event of successful authentication of said bar code by said second bar-code reader.

17. The method of claim 6 further comprising subsequently performing a cryptographic authentication of said indicium and automatically collating said mail piece to an eighth paper path in the event of unsuccessful authentication of said bar code by said second bar-code reader.

18. The method of claim 9 further comprising subsequently performing a cryptographic authentication of said indicium and automatically collating said mail piece to a ninth paper path in the event of successful authentication of said bar code by said third bar-code reader.

19. The method of claim 9 further comprising subsequently performing a cryptographic authentication of said indicium and automatically collating said mail piece to a tenth paper path in the event of unsuccessful authentication of said bar code by said third bar-code reader.

20. An improved system for authentication of mail pieces bearing bar-coded indicia, the system comprising first, second, and third bar-code readers, said first and third bar-code readers differing in that said first bar-code reader has a lower rate of successful reading of bar-coded indicia than said third bar-code reader, said second and third bar-code readers differing in that said second bar-code reader has a lower rate of successful reading of bar-coded indicia than said third bar-code reader, said system defining a first paper path through said first bar-code reader and subsequently through a first collator, said system disposed to collate a mail piece bearing an indicium in a second paper path in the event of a successful reading of said bar-coded indicium by said first bar-code reader, said system disposed to collate mail pieces in a third paper path in the event of an unsuccessful reading of said bar-coded indicium by said first bar-code reader, said third paper path leading to said third bar-code reader, said system defining a fourth paper path through said second bar-code reader and subsequently through a second collator, said system disposed to collate a mail piece bearing an indicium in a fifth paper path in the event of a successful reading of said bar-coded indicium by said second bar-code reader, said system disposed to collate mail pieces in a sixth paper path in the event of an unsuccessful reading of said bar-coded indicium by said second bar-code reader, said sixth paper path leading to said third bar-code reader said system disposed to collate mail pieces in a seventh paper path in the event of a successful reading of said bar-coded indicium by said third bar-code reader, said system disposed to collate mail pieces in an eighth paper path in the event of all unsuccessful reading of said bar-coded indicium by said third bar-code reader.

21. The improved system of claim 20 wherein the first and second bar-code readers are each less expensive than the third bar-code reader.

22. The improved system of claim 20 wherein the first and second bar-code readers are each faster than the third bar-code reader.

23. The improved system of claim 20 wherein the first and second bar-code readers each have lower scanning resolution than the third bar-code reader.

* * * * *